United States Patent [19]

MacKechnie

[11] Patent Number: 4,623,142

[45] Date of Patent: Nov. 18, 1986

[54] HAND HELD, MULTI-DIRECTIONAL DEVICE FOR AQUATIC EXERCISING

[76] Inventor: Bruce MacKechnie, 4954 Sauquoit La., Annandale, Va. 22003

[21] Appl. No.: 575,589

[22] Filed: Jan. 31, 1984

[51] Int. Cl.[4] ..... A63B 21/00

[52] U.S. Cl. ..... 272/116

[58] Field of Search ..... 272/130, 71, 96, 116, 272/122, 123

[56] References Cited

U.S. PATENT DOCUMENTS

| | | | |
|---|---|---|---|
| 2,470,815 | 5/1949 | Harvey | 272/123 |
| 3,726,522 | 4/1973 | Silberman | 272/123 |
| 4,029,312 | 6/1977 | Wright | 272/122 |
| 4,311,306 | 1/1982 | Solloway . | |
| 4,411,422 | 10/1983 | Solloway . | |

*Primary Examiner*—Richard J. Apley
*Assistant Examiner*—James Prizant
*Attorney, Agent, or Firm*—Birch, Stewart, Kolasch & Birch

[57] ABSTRACT

An aquatic exercising device including a handle member having a first end and a second end. A first resistance member is operatively affixed to the first end of the handle. A second resistance member is operatively affixed to the second end of the handle. Movement of the aquatic exercising device through a body of water produces a resistance to enhance the exercising capability of an individual utilizing the aquatic exercising device.

6 Claims, 17 Drawing Figures

HAND HELD, MULTI-DIRECTIONAL DEVICE FOR AQUATIC EXERCISING

BACKGROUND OF THE INVENTION

Field of the Invention

The present invention relates generally to a physical exercising device and more particularly to a hand held, multi-directional, varied resistance device used in the performance of aquatic exercises.

Exercise is recognized as an important aspect of maintaining or improving one's health at any age. Aquatic exercise is a very pleasant way to exercise the muscles and the cardio-vascular system because the body is cooled by the water and the movements are relatively smooth, rhythmic and easily moderated so that the chance of injury is greatly reduced. Water also increases the amount of effort needed to move the arms or legs in any direction, thus providing an excellent medium in which to exercise the entire body.

Various devices have been produced to facilitate the act of propelling oneself through the water by swimming with hand paddles or flippers on the feet. One device, U.S. Pat. No. 2,850,748, has been designed for use in performing certain aquatic exercises as well as for swimming.

However, such a prior device does not recognize the advantage in providing multiple surfaces so configured as to enable the user to perform a broader range of exercises by being able to move the device in any direction through the water.

Likewise, the prior device does not recognize the advantage of having multiple surfaces of varied size which enables the user to quickly and conveniently vary the resistance of the device simply by regripping the device after turning the device a quarter turn from the previously held position. Instead, the previous device requires the user to loosen several screws, make an adjustment and then retighten the screws in order to alter the resistance characteristics of the device. Also, the previous device does not recognize the advantage of being able to use a single device in either the left or right hand. Furthermore, the prior device does not recognize the advantage of having vanes as well as funnels connected by a hollow, rigid tube which function to stabilize the device as said device moves through the water without using heavy, lead ballasts which makes the previous device sink to the bottom if released in the water and makes the device more of a burden to transport. In addition, the prior device does not recognize the advantage of being able to connect two devices together, thus limiting itself to single hand use and further limiting the range of exercises.

SUMMARY AND OBJECTS OF THE INVENTION

The present invention provides a hand held, multi-directional, varied resistance device to enable a person to obtain a complete and thorough work-out of the forearms, upper arms, shoulders, upper and lower back, chest, sides and stomach while exercising in the water. By moving the device from side to side, backwards and forwards, up and down, in circular motions and by rotating the device a user can tone and build the muscles as well as improve the user's cardio-vascular system depending on how vigorously the various exercises are performed.

The primary objective of this invention is to provide a balanced, easily gripped, hand held device which will substantially increase the amount of effort needed to move the hands through the water in any direction, thus enabling the user to obtain a complete and thorough work-out of the upper body.

Another objective of this invention is to provide a hand held device with varied surface areas for the purpose of enabling the user to perform exercises at different rates of speed or with greater or lesser amounts of resistance.

Another objective of this invention is to provide a lightweight hand held device that can be easily transported and used by virtually anyone for therapeutic exercises, muscle toning and muscle building.

Another objective of this invention is to provide a hand held device which can be made from a material, such as plastic, which will not readily sink in water, and which will be chemically resistant, durable and inexpensive to produce.

Another objective of this invention is to be able to join two devices together to expand the range of exercises available to the user.

The present invention provides a device for increasing the resistance of the hand as the hand holding the device moves through a body of water in any direction. The device consists of a hollow, rigid tube which the user grips when using the device. In a first embodiment, a multi-faceted component or head consisting of a funnel shape to provide resistance when the device is moved directly headfirst through the water is connected to each end of the grip tube. Four equally spaced side vanes are attached to the outside of the funnel which provide resistance when the device is moved directly broadside through the water or when the device is rotated back and forth by turning the hand without moving the arm. The hollow tube connecting the open funnels, channels the water through the device which helps to stabilize the device as it moves through the water. The side vanes also act as stabilizers. Being of varied sizes each pair of vanes on each head component provides a different total surface area so that the device will provide the most resistance when held and moved through the water in such a manner that the broad surface of the largest pair of vanes is perpendicular to the direction of the movement of the device. The least resistance is obtained when the smaller vanes are positioned perpendicular to the general direction of movement of the device. Two devices can be attached end-to-end to create a long device for doing exercises enabling the user to grip the device with both hands such as when performing a rowing exercise.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
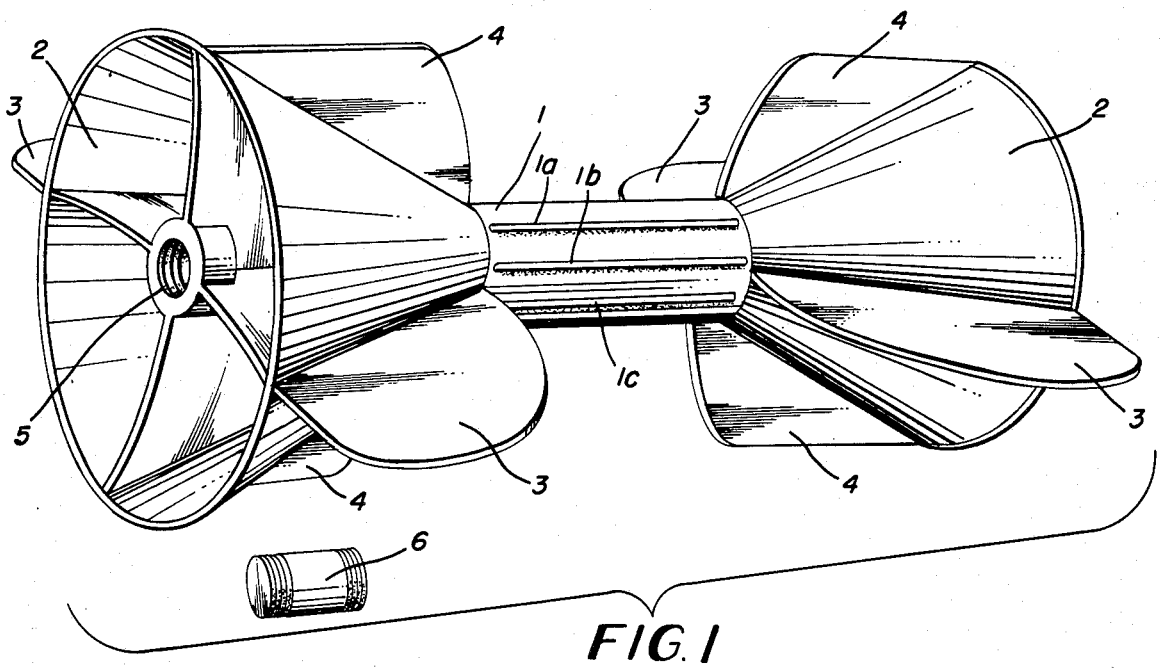
FIG. 1 is an illustration in perspective view of the entire device plus a connecting tube.
Figure 2:
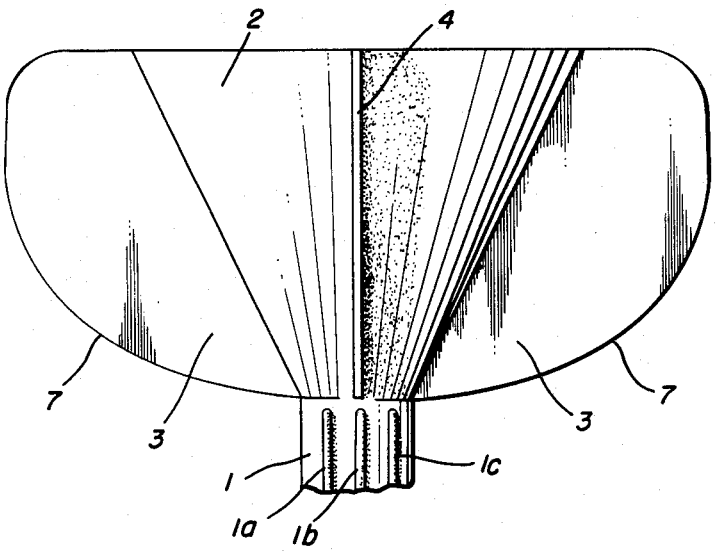
FIG. 2 is a side view of one multi-directional head component showing the large set of vanes.
Figure 3:
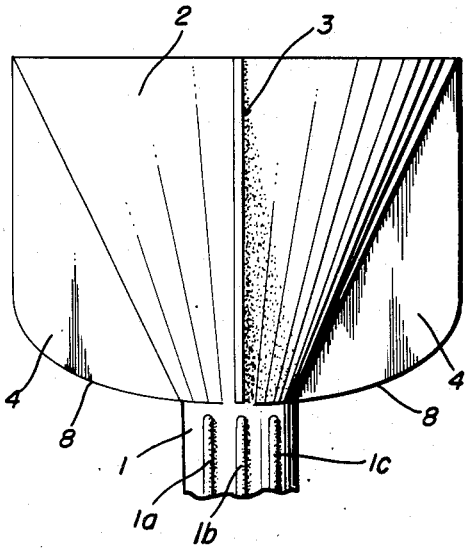
FIG. 3 is a side view of one multi-directional head component showing the small set of vanes.
Figure 4:
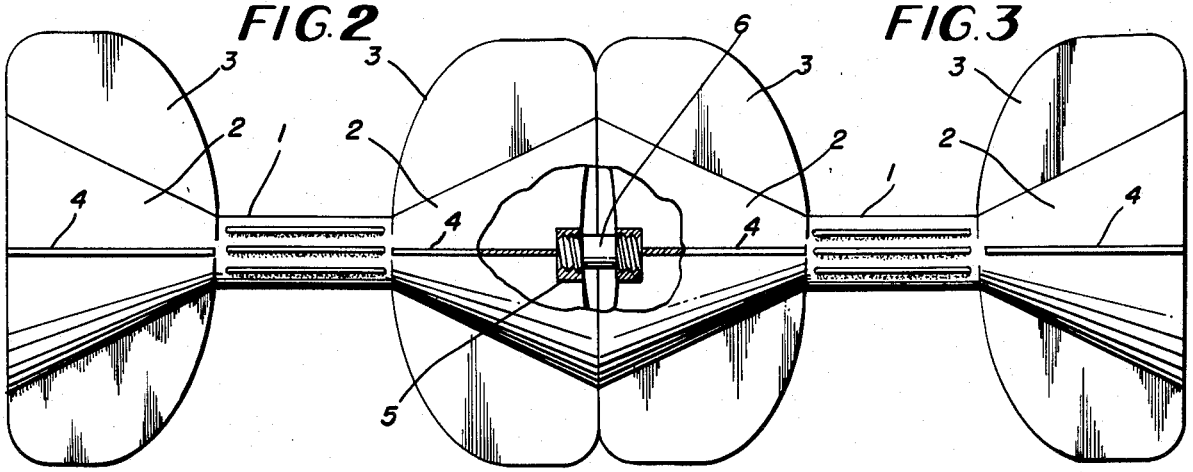
FIG. 4 is a side view with a cut-away section showing one example of how two devices may be joined together end-to-end with a connector tube.

Referring to FIGS. 1–4, a hollow handle 1 is operatively positioned between two opened funnels 2. The hollow handle 1 includes ridges 1*a*, 1*b*, 1*c* . . . which facilitate the gripping of the handle by an individual utilizing the aquatic exercising device. The opened funnel 2 includes vanes 3, 4 which are arranged substantially orthogonally with respect to each other. A coupler socket 5 is positioned at the intersection of the vanes 3, 4 and is centrally mounted with respect to the open end of the opened funnel 2. Each side of the hollow handle 1 includes an opened funnel 2 substantially as described hereinabove. A connector tube 6 may be provided to operatively connect one aquatic exercising device to another, as illustrated in FIG. 4.

FIG. 2 is side view of the vanes 3. The vanes 3 are substantially enlarged with respect to the vanes 4. The vane edge 7 is provided with a curved and rounded shape in order to allow adequate clearance for the wrist and forearm of an individual utilizing the aquatic exercising device during the performance of various exercises.

FIG. 3 is a side view of the vane 4. The vane 4 is substantially smaller with respect to the vane 3. Again, the vane edge 8 is curved and rounded so as to provide adequate clearance for the wrist and forearm of an individual utilizing the aquatic exercising device.

The vanes 3 and 4 may be permanently attached to the hollow handle 1 as illustrated in FIGS. 1–4. In addition, the vanes 3 and 4 may be detachably connected so as to permit various sizes of vanes to be inserted relative to the hollow handle 1, thereby permitting the aquatic exercising device to accommodate varying strengths and objectives of individuals utilizing the device. In addition, different handle sizes could be provided in a component system which would enable the user to choose the grip size that feels the most comfortable.

Figure 5A:
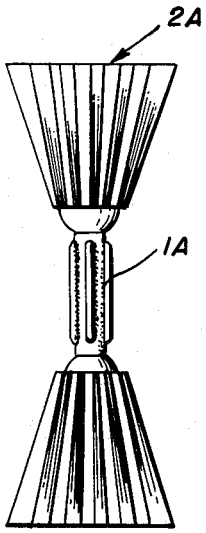
FIG. 5A is a side view of a second embodiment of the present invention.
Figure 5B:
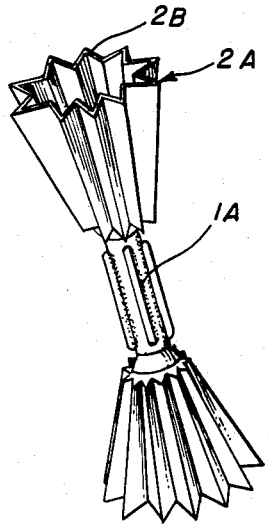
FIG. 5B is a perspective view of the second embodiment of the present invention.

FIGS. 5A and 5B illustrate a second embodiment of the present invention. Opened funnels 2A are mounted on a hollow handle 1A. The opened funnels 2A include a varigated outer surface 2B which provides resistance as an individual utilizes the aquatic exercising device and pulls it through the water. Again, the opened funnels 2A may be removably attached to the hollow handle 1A so as to permit a variety of different sizes of varigated shapes to increase or decrease the resistance to the water as the aquatic exercising device is utilized.

Figure 6A:
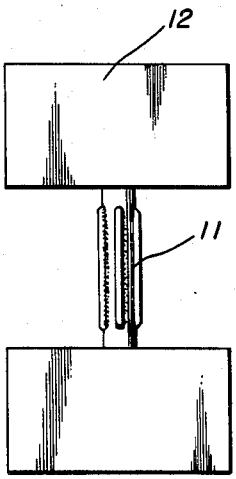
FIG. 6A is a side view of a third embodiment of the present invention.
Figure 6B:
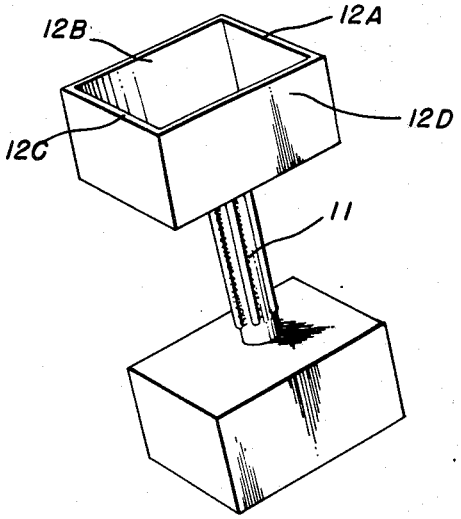
FIG. 6B is a perspective view of the third embodiment of the present invention.

FIGS. 6A and 6B illustrate a third embodiment of the present invention. A substantially rectangular opened box 12 is mounted on a hollow handle 11. The rectangular box 12 includes sides 12A, 12B, 12C and 12D. The sides 12B and 12D are longer in length as compared to the sides 12A and 12C. Therefore, an individual utilizing the aquatic exercising device may increase the resistance to the water by merely rotating the device approximately 90° in his/her hand. Again, the opened rectangular boxes 12 may be removably affixed to the hollow handle 11 so as to permit various sizes of opened rectangular boxes to be affixed thereto. the various sizes of rectangular boxes would increase or decrease the resistance of the aquatic exercising device as it is pulled through the water.

Figure 7A:
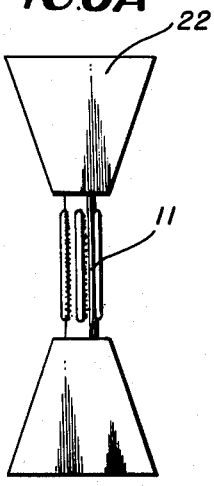
FIG. 7A is a side view of a fourth embodiment of the present invention.
Figure 7B:
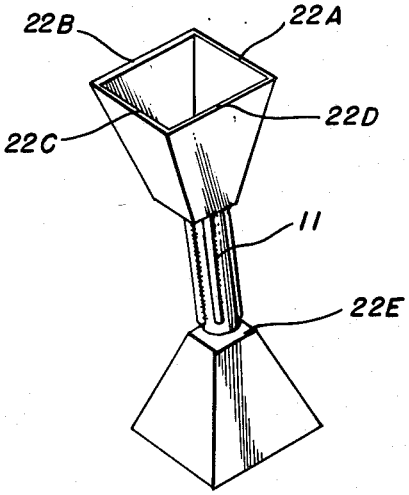
FIG. 7B is a perspective view of the fourth embodiment of the present invention.

FIGS. 7A and 7B illustrate a fourth embodiment of the present invention. An opened funnel 22 includes sides 22A, 22B, 22C and 22D. The sides 22A, 22D form a substantial square on the outer surface thereof. The sides are tapered inwardly so that a smaller square 22E is formed adjacent to the hollow handle 11. Again, the opened funnels 22 may be detachably connected to the hollow handle 11. In this manner, a variety of different sizes of opened funnels 22 may be operatively connected to the hollow handle 11 to increase or decrease the resistance of the aquatic exercising device as it is pulled through the water.

Figure 8A:
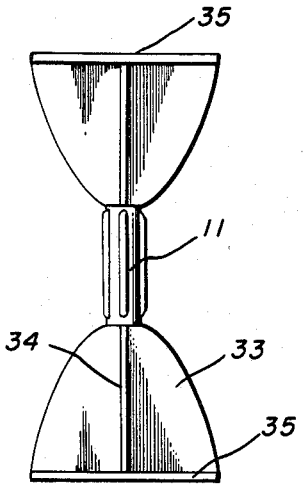
FIG. 8A is a side view of a fifth embodiment of the present invention.
Figure 8B:
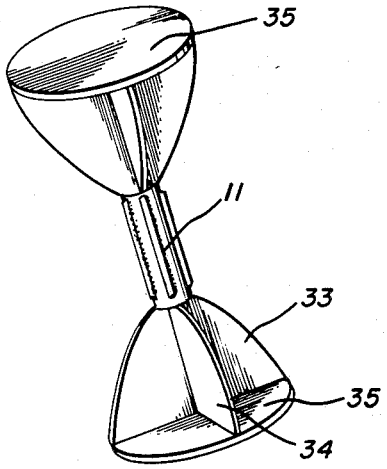
FIG. 8B is a perspective view of the fifth embodiment of the present invention.

FIGS. 8A and 8B illustrate a fifth embodiment of the present invention. A hollow handle 11 is connected to vanes 33, 34. The vanes 33, 34 are substantially orthogonally disposed with respect to each other and include a disk 35 which is mounted adjacent to the outer ends of the vanes 33, 34. The vanes 33, 34 may be removably affixed to the hollow handle 11. In this manner, a plurality of different sizes of vanes may be connected to the hollow handle to increase or decrease the resistance of the aquatic exercising device as it is pulled through the water.

Figure 9A:
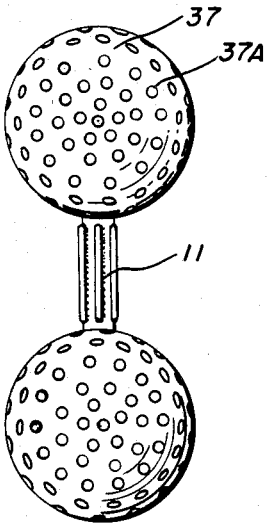
FIG. 9A is a side view of a sixth embodiment of the present invention.
Figure 9B:
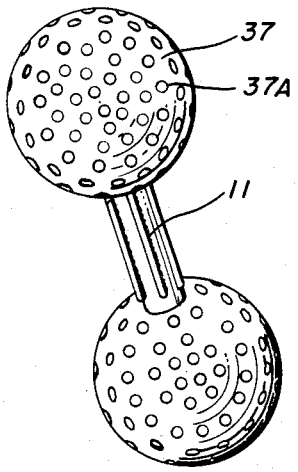
FIG. 9B is a perspective view of the sixth embodiment of the present invention.

FIGS. 9A and 9B illustrate a sixth embodiment of the present invention. Balls 37 are operatively connected to a hollow handle 11. The balls 37 are hollow globes which include a plurality of holes 37A drilled therethrough. In this manner, water may pass through the holes as the aquatic exercising device is pulled through the water. Again, the balls 37 may be removably affixed relative to the handle 11 to permit an individual to detach the balls and replace the balls with various sizes of balls to increase or decrease the resistance as the device is pulled through the water.

Figure 10A:
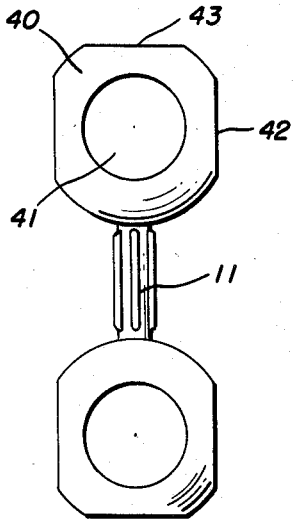
FIG. 10A is a side view of a seventh embodiment of the present invention.
Figure 10B:
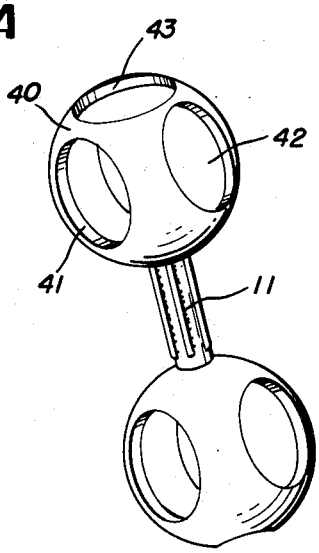
FIG. 10B is a perspective view of the seventh embodiment of the present invention.

FIGS. 10A and 10B illustrate a seventh embodiment of the present invention. Hollow globes 40 are operatively connected to a hollow handle 11. The hollow globes 40 include a plurality of holes 41, 42, 43 . . . operatively disposed therein. In a preferred embodiment five large holes are drilled through the aquatic exercising device. The hollow globes 40 may be removably affixed relative to the handle 11. In this manner, a variety of various sizes of hollow globes may be attached to the hollow handle 11 to increase or decrease the resistance as the aquatic device is pulled through the water.

Figure 11:
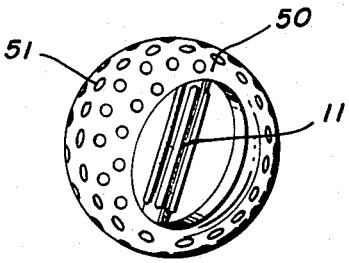
FIG. 11 is a perspective view of an eighth embodiment of the present invention.

FIG. 11 illustrates an eighth embodiment of the present invention. The handle 11 is operatively connected within a large hollow globe 50. The large hollow globe 50 includes a plurality of openings 51 positioned therethrough. The globe 50 and the handle 11 may be constructed in a variety of sizes to increase the resistance of the aquatic exercising device as it is pulled through the water.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An aquatic exercising device comprising:

a hollow handle member having a first end and a second end;

said handle member being substantially round and includes a textured surface, said substantially round handle member enables an individual to grip the handle at any point therearound while said textured surface permits an individual to securely grasp the handle member;

a first substantially funnel shaped support operatively connected to said first end of said handle;

a second substantially funnel shaped support operatively connected to said second end of said handle;

said first and second substantially funnel shaped supports being hollow and said hollow space being in communication with said hollow space in said handle member to permit water to flow therebetween;

a first plurality of vanes operatively affixed to said first substantially funnel shaped support and extending within said hollow space of said first substantially funnel-shaped support; and a second plurality of vanes operatively affixed to said second substantially funnel shaped support and extending within said hollow space of said second substantially funnel shaped support;

whereby movement of said aquatic exercising device through a body of water produces a resistance to enhance the exercising capability of an individual utilizing the aquatic exercising device;

said plurality of first and second vanes includes a first resistance member which is smaller in size relative to the vane forming a second resistance member to provide substantially different resistance as each of the vanes are moved through a body of water and said second resistance member projects outwardly from said funnel shaped supports beyond the diameter of the largest opening of said funnel shaped supports for improving the stability of the aquatic exercising device as it moves through a body of water.

2. An aquatic exercising device according to claim 1, wherein said textured surface includes a plurality of ridges extending along a length direction thereof.

3. An aquatic exercising device according to claim 1, wherein said first and second substantially funnel shaped supports include a serrated outer surface.

4. An aquatic exercising device according to claim 1, and further including a connector tube operatively secured to one of said plurality of first or second vanes to enable two aquatic exercising devices to be affixed to one adjacent another.

5. An aquatic exercising device according to claim 1, wherein said first and second plurality of vanes are substantially orthogonally disposed with respect to each other.

6. An aquatic exercising device according to claim 5, wherein said plurality of first and second vanes are curved and rounded to permit adequate clearance for the wrist and forearm of an individual utilizing the aquatic exercising device.

* * * * *